US006237843B1

(12) United States Patent
Falat et al.

(10) Patent No.: US 6,237,843 B1
(45) Date of Patent: May 29, 2001

(54) CONTAINER LID WITH PRINTED COUPON

(75) Inventors: Ladislav Falat, Columbia; Christopher J. Parks, Ellicott City, both of MD (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/388,072

(22) Filed: Sep. 1, 1999

(51) Int. Cl.[7] ..... B65D 5/42

(52) U.S. Cl. ..... 229/125.35; 206/459.5; 206/831

(58) Field of Search ..... 229/123.2, 125.35, 229/902; 206/459.5, 831; 40/324

(56) References Cited

U.S. PATENT DOCUMENTS

| | | | | |
|---|---|---|---|---|
| 2,880,859 | * | 4/1959 | Tupper | 229/123.2 |
| 3,147,856 | | 9/1964 | Lightner et al. . | |
| 3,389,850 | | 6/1968 | Rockefeller . | |
| 3,415,407 | * | 12/1968 | Alden et al. | 206/459.5 |
| 3,615,005 | * | 10/1971 | Segel et al. | 229/125.35 |
| 3,640,447 | | 2/1972 | Forbes, Jr. et al. . | |
| 3,863,832 | | 2/1975 | Gordon et al. . | |
| 4,346,833 | * | 8/1982 | Bernhardt | 206/459.5 |
| 4,706,873 | * | 11/1987 | Schulz | 40/324 |
| 4,969,595 | * | 11/1990 | Teasdale | 206/459.5 |
| 5,074,462 | * | 12/1991 | Countee, Jr. | 206/831 |
| 5,282,534 | * | 2/1994 | Lapp | 206/831 |
| 5,379,887 | * | 1/1995 | Conley, Jr. | 206/459.5 |
| 5,418,008 | | 5/1995 | Calvert . | |
| 5,538,135 | * | 7/1996 | Hexter, Jr. | 206/459.5 |
| 5,866,181 | * | 2/1999 | Hill | 206/459.5 |
| 6,092,662 | * | 7/2000 | Frederick, Jr. | 206/459.5 |

* cited by examiner

*Primary Examiner*—Gary E. Elkins

(57) ABSTRACT

A coupon bearing lid component for a container is prepared from a sheet of paperboard, said paperboard having an outer surface with a finished coating for printing graphics and an inner surface on which coupon indicia is printed, the improvement wherein the inner surface of the lid has bonded thereto a polymeric film to cover the printed coupon indicia.

10 Claims, 1 Drawing Sheet

CONTAINER LID WITH PRINTED COUPON

BACKGROUND OF INVENTION

Figure 1:
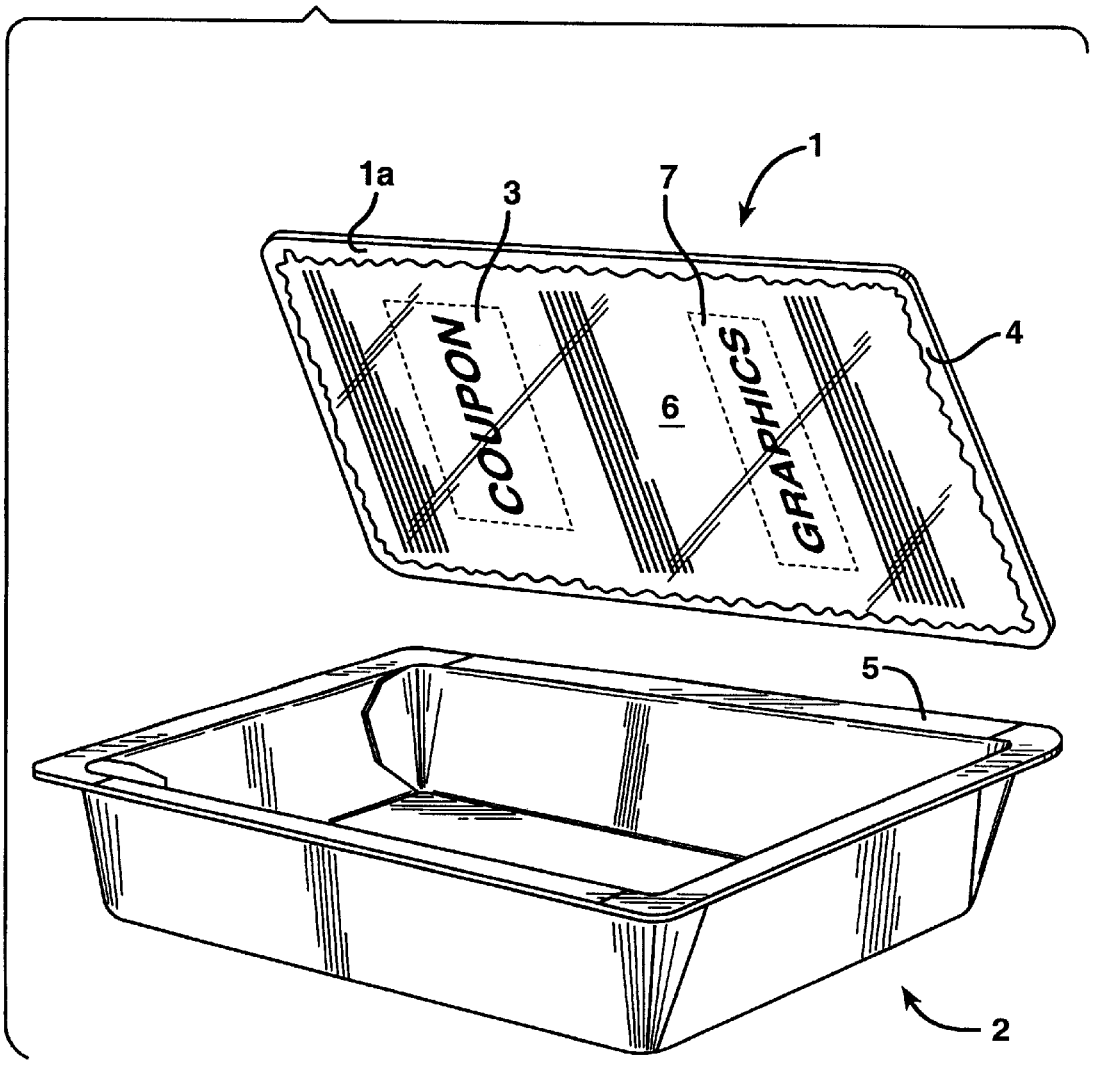

The present invention relates generally to food packaging and more particularly to a food package prepared from paperboard which incorporates a redeemable coupon that is printed directly on the packaging material.

The use of coupons or the like in packaging is well known. U.S. Pat. No. 3,389,850 for example, shows a tubular carton structure with an integral interior panel in the form of a coupon. It is also known to include coupons or other inserts in packaging located within an interior compartment (U.S. Pat. No. 3,147,856), or within a pocket formed between an inner, protective film and the package (U.S. Pat. No. 3,640,447). When the package is used for food products, the most important requirement is the necessity of keeping the food and coupon isolated from one another to prevent contamination. For example, if the coupon or insert is included loosely within the food package it should be separately wrapped. If the coupon is included as a part of the package it may be printed directly on a package panel either on the interior or exterior of the package. However, in any case, provisions should be made to make sure the coupon is available to the consumer in such a manner that access is convenient and without the need for the consumer to clean food off the printed material.

SUMMARY OF INVENTION

The preferred food packaging container of the present invention includes a lid and tray prepared from paperboard, wherein the interior surfaces of the lid and tray are covered with a food contact barrier material. Meanwhile, the outer surfaces of the lid and tray are coated with a clay coating suitable for printing high quality graphics. A typical example of such a food container is disclosed in U.S. Pat. No. 3,863,832, wherein there is illustrated a separate tray and lid in which the tray includes a peripheral flange to which the lid is bonded. It is to be understood, however, that the food package of the present invention may take any desired shape or form including a one piece construction if desired.

It will be appreciated that for food packages as disclosed in the '832 patent and as preferred herein, it is substantially impossible to include a coupon or the like loosely in the food compartment. This means that a coupon if desired would of necessity have to be attached to or included as a part of the exterior of the food package. In this regard, it will be noted that in merchandizing practice, a coupon that is visible or partly visible when the package is in its normal use has more attention drawing potential than a mere statement on the package that a coupon is being offered. However, the size of the coupon cannot be so large that it detracts from the brand identity and other graphics associated with the packaged products.

In order to overcome these problems and still achieve the desired advantage of offering a coupon with a food package as disclosed, the coupon indicia of the present invention is printed directly on the inner surface of the container lid. The lid is perforated around the coupon indicia for easy removal of the coupon portion of the lid by the consumer, and an interior liner member is bonded to the inner surface of the lid so as to cover the coupon indicia and perforations and keep the printed matter from coming into contact with the packaged food product.

In accordance with the present invention, the interior liner member may be patched to the inner surface of the lid using conventional equipment over the coupon indicia either before or at the same time that the lid is printed and die cut. The liner member may be sized so as to cover only the printed coupon indicia and perforations, or so as to cover the entirety of the lid inner surface. Where the liner member covers the entirety of the lid inner surface, the material chosen for the liner member must be capable of being bonded either with the use of heat or microwave energy to the flanges of the food tray.

BRIEF DESCRIPTION OF THE DRAWING(S)

FIG. 1 is an isometric view of a container according to one embodiment of the present invention, which includes a tray, and a lid having formed therein a coupon portion and further including an interior liner member covering the interior surface of the lid.

DETAILED DESCRIPTION

The coupon bearing lids of the present invention As represented by the package shown in FIG. 1, suitable graphics 7 are printed on the clay coated side 1*a* of a C1S substrate (e.g., 16 or 18 point paperboard), followed (or preceded) by the printing of the coupon indicia 3 on the uncoated surface of the substrate. The lid 1 may also be perforated around the coupon indicia 3 for easy removal, and an adhesive (not shown) is applied around the periphery 4 of the uncoated surface of the lid where the tray flange 5 is bonded to the lid 1, followed by application of a food contact, moisture barrier interior liner member 6 such as polyester film. The adhesive/film application can be accomplished on conventional equipment used for applying window materials over openings in envelopes, cartons or the like. An example of a film material suitable for use in the present invention is DuPont's OL series films since they are generally heat sealable and meet FDA regulations for food contact. Upon development of FDA approved adhesive materials, the film material could be applied only over the printed indicia and perforations of the coupon.

Regarding the tray component 2 of the preferred two piece package of the present invention, it is the usual practice that the product contact surface be coated with a moisture barrier, and preferably one capable of being sealed to the lid 1 either by heat or with the use of microwave energy. Typical coatings used for this purpose in the past include extrudable resins such as low density polyethylene (LDPE), polypropylene (PP) and polyethylene terephthlate (PET). However, since extrudable resins for such purpose must be applied in a process separate from the manufacture of the paperboard substrate, or the printing step, the process disclosed in U.S. Pat. No. 5,418,008 was developed. According to the teachings of the '008 patent, a paperboard substrate which has been previously coated on one (C1S) or both (C2S) surfaces during the manufacturing process, may be applied with a continuous, moisture resistant, product contact barrier in a single pass on a printing press. Thus for the present invention, the preferred manufacture of the tray component is carried out in accordance with the teachings of the '008 patent. Suitable and effective product contact coatings, of the type useful for the present invention are prepared from emulsions of acrylics, ethylene vinyl chloride (EVCL), polyvinylidene chloride (PVDC), and PET. For the present invention EVCL is preferred because of its ability to be bonded easily with the preferred polyester films used to cover the coupon bearing lid component. When C1S paperboard is used, the moisture barrier emulsion is applied to the uncoated surface to achieve a coat weight of from about 4 to 12 lbs/ream (ream size 3000 $ft^2$) and for C2S paperboard a coat weight of from about 3 to 9 lbs/ream (ream size 3000 $ft^2$). A representative source for the preferred EVCL emulsion is Michelman.

While the description set forth herein is focussed on food packaging applications, it is to be understood that the present invention could also be applicable to other paperboard packaging applications where barrier properties and/or heat seal properties are needed. Thus, the present invention provides a flexibility not heretofore addressed by the art.

Once given the above disclosure, many features, modifications, or improvements will become apparent to one skilled in the art. Such features, modifications, or improvements are, therefore, to be considered a part of this invention, the scope of which is to be determined by the following claims.

What is claimed is:

1. A coupon bearing food container prepared from paperboard comprising, a tray and lid, said tray including a peripheral flange to which the lid is sealed for closing the container, said tray and lid each having inner and outer surfaces, a finished coating on the outer surfaces of said tray and lid for printing graphics, and a moisture barrier food contact coating on at least the inner surface of said tray including the flange, for providing a food contact surface and a means for closing the container after it is filled, the improvement comprising indicia in the form of a redeemable coupon printed on the inner surface of said lid and an interior liner member bonded thereto to cover at least said coupon indicia and to keep the coupon indicia from contacting a food product located in said tray.

2. The container of claim 1, wherein the finished coating comprises the dried residue of a fluidized blend of pigments including coating clay, calcium carbonate and titanium dioxide, in combination with a suitable binder selected from the group consisting of starch, polyvinyl alcohol and polystyrene.

3. The container of claim 2 wherein the moisture barrier food contact coating comprises a polymer selected from the group consisting of polyester, acrylics, ethylene vinyl chloride and polyvinylidene chloride.

4. The container of claim 3 wherein the interior liner member comprises a sheet of polymeric film.

5. The container of claim 4 wherein the polymeric film is a crystalline polyester material.

6. The container of claim 5 wherein the liner member covers substantially the entirety of said lid and has the capability of being bonded to the moisture barrier layer on the tray flanges.

7. The container of claim 6 wherein the lid is bonded to the tray flanges by heat sealing.

8. The container of claim 6 wherein the lid is bonded to the tray flanges with the use of microwave energy.

9. The container of claim 6 wherein the lid is perforated around the periphery of the coupon indicia to permit easy removal of the coupon from the lid.

10. The container of claim 5 wherein the lid is perforated around the periphery of the coupon indicia and the liner member covers only the coupon indicia and perforations.

* * * * *